United States Patent [19]

Gale et al.

[11] 4,414,610

[45] Nov. 8, 1983

[54] LASER-SIGHTED BRIEFCASE FIRING DEVICE

[76] Inventors: Edward A. Gale, 18104 Nottingham Rd., Cleveland, Ohio 44119; John J. Wetzel, III, 2005 Fernwood St.; James H. Wetzel, 2499 Trinity Dr., both of Middletown, Ohio 45042

[21] Appl. No.: 222,028

[22] Filed: Jan. 2, 1981

[51] Int. Cl.[3] ..... F41G 1/34

[52] U.S. Cl. ..... 362/113; 362/110; 362/156; 362/259; 42/1 A; 42/13; 42/15

[58] Field of Search ..... 362/110, 113, 154, 156, 362/259; 42/1 A, 13, 15, 12

[56] References Cited

U.S. PATENT DOCUMENTS

| | | | |
|---|---|---|---|
| 3,354,570 | 11/1967 | Rizzo | 42/1 A |
| 3,707,794 | 1/1973 | Rocha | 42/1 J |
| 4,313,272 | 2/1982 | Matthews | 42/1 A |

*Primary Examiner*—Donald P. Walsh

*Attorney, Agent, or Firm*—Pearne, Gordon, Sessions, McCoy, Granger & Tilberry

[57] ABSTRACT

A laser-sighted firing device adapted to be carried in a portable enclosure, such as a briefcase, to conceal the device from detection. The device includes a firing piece and a laser-type sighting device mounted on a rigid base. The sighting device is adapted to project an aiming spot to a target along a sight line generally parallel to the line of fire of the firing piece. The sighting device is resiliently mounted on the base and means are provided for adjusting the device to calibrate the laser spot relative to the line of fire of the firing piece. The firing piece has a trigger mechanism that is operated by a lever pivotally mounted at one end on the base and connected at the other end to a solenoid-actuated operating means. The lever is operatively connected intermediate its ends to the trigger mechanism for firing the piece in response to actuation of the solenoid. A power supply is provided for the laser generator and an electrical system is provided for activating the power supply and for controlling the solenoid from a remote switch.

8 Claims, 7 Drawing Figures

LASER-SIGHTED BRIEFCASE FIRING DEVICE

BACKGROUND OF THE INVENTION

This invention relates to manually operated portable weapons normally classified as small arms and to a laser sighting system associated therewith. More particularly, the invention relates to a firing device and associated laser sighting system that can be readily transported by the user without the presence and nature of the device being known and that may be operated by an electrical switch located remotely from the mechanical trigger mechanism.

Law enforcement personnel throughout the world are frequently faced with hostage situations and other terrorist activities. The terrorists are generally desperate and ruthless and difficult to counter with conventional weapons. If they are threatened with visible weapons, they may injure or kill hostages, as well as innocent bystanders. On the other hand, the use of weapons by law enforcement personnel themselves usually involves still greater risk that hostages or innocent bystanders may be caught in the crossfire.

One recent development that presents promise for improved capability in this area is the laser generator type sighting device such as those shown in U.S. Pat. Nos. 4,152,754 and 4,026,054. The laser generator is normally mounted on a firing piece, such as a rifle, and aligned with the rifle bore. When the generator is switched on, it projects an invisible laser beam that places a visible aiming spot on the target. The laser beam is calibrated relative to the weapon so that the line of fire of the weapon extends approximately parallel to the beam. This avoids the need for visually sighting along the barrel of the weapon, as with conventional rifles and the like, and enables the weapon to be fired accurately while held at the hip or other "fast" firing positions.

The device of the present invention utilizes the advantages of laser sighting in an assembly that may be easily transported, such as in a briefcase, in a way that it cannot be detected and is not threatening to a prospective target.

SUMMARY OF THE INVENTION

The device of the invention comprises a rigid mounting base with a firing piece and a sighting device mounted thereon. The sighting device includes a laser generator for projecting a visible aiming spot on a target along the line of fire of the piece. The laser generator is resiliently supported and has means for adjusting its position relative to the firing piece to calibrate the laser beam projected therefrom relative to the line of fire. The firing piece has a mechanical trigger mechanism that is operated by means of a lever pivotally mounted at one end on the base for pivotal movement about an axis perpendicular to the base. The other end of the lever is operatively connected to a solenoid and means are provided intermediate the ends of the lever operatively connected to the trigger mechanism for firing the piece in response to operation of the solenoid. Also mounted on the base is the power supply for the laser generator and an electrical system for energizing the solenoid in response to operation of a manual switch. As indicated above, the assembly thus described is adapted for mounting in a portable enclosure, such as a briefcase, and the switches for controlling the operation of the laser generator and the solenoid are located externally for ready access by the user.

DESCRIPTION OF THE PREFERRED EMBODIMENT

Figure 1:
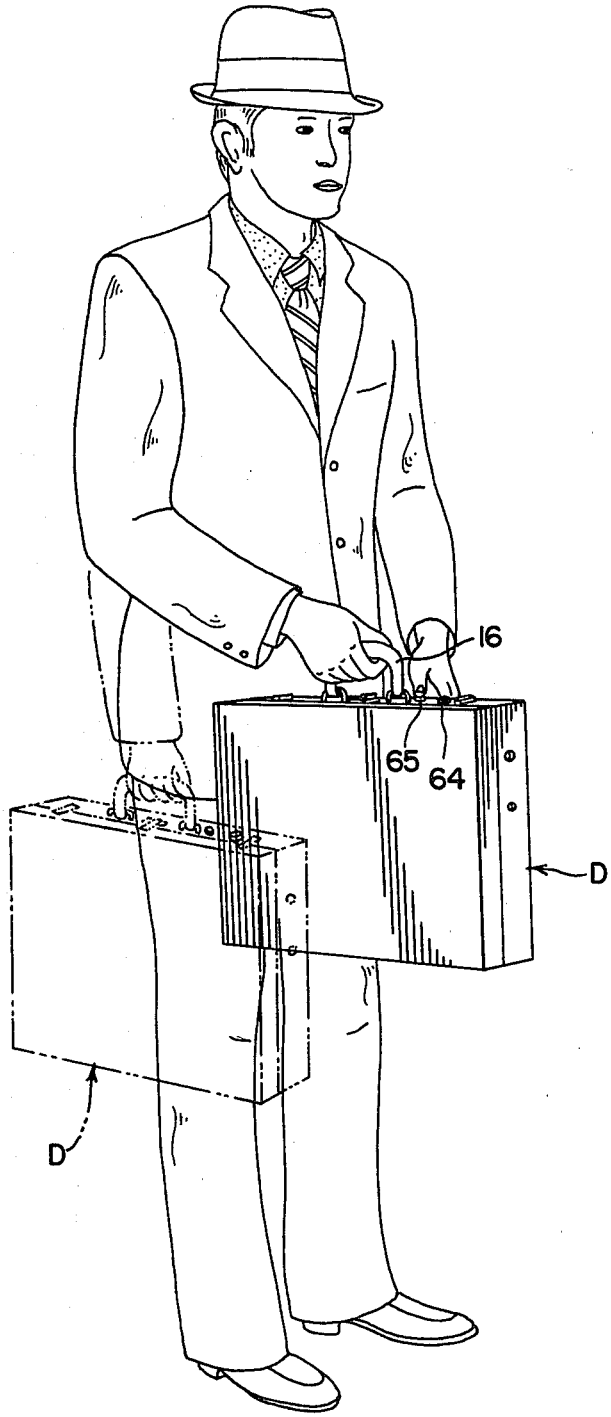
FIG. 1 is a perspective view illustrating the firing device of the invention enclosed in a conventional briefcase carried by the operator. The case is shown in a typical firing position in solid lines and in a normal carrying position in dashed lines.
Figure 2:
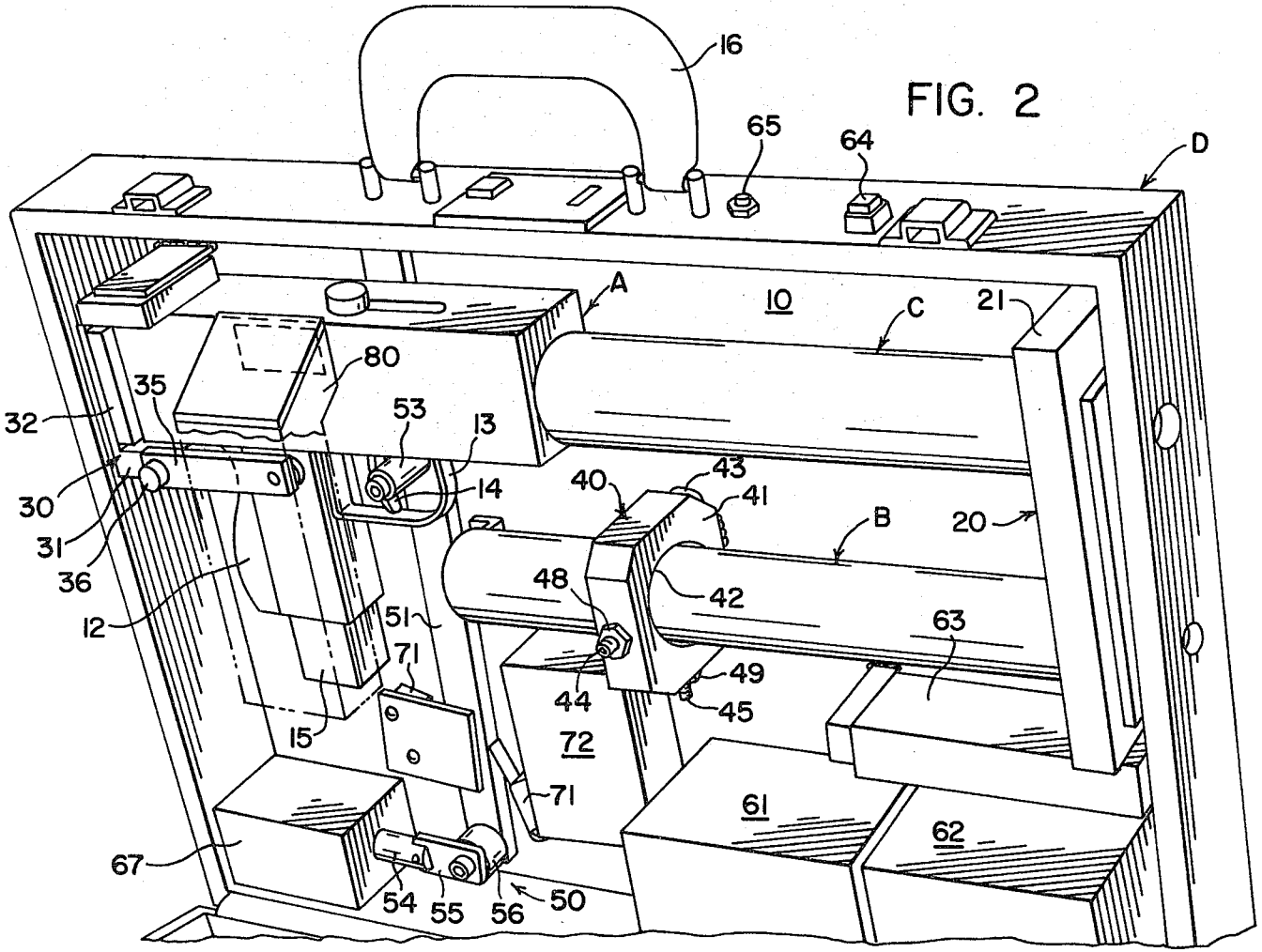
FIG. 2 is a perspective view showing the case open to reveal the components of the device.
Figure 3:
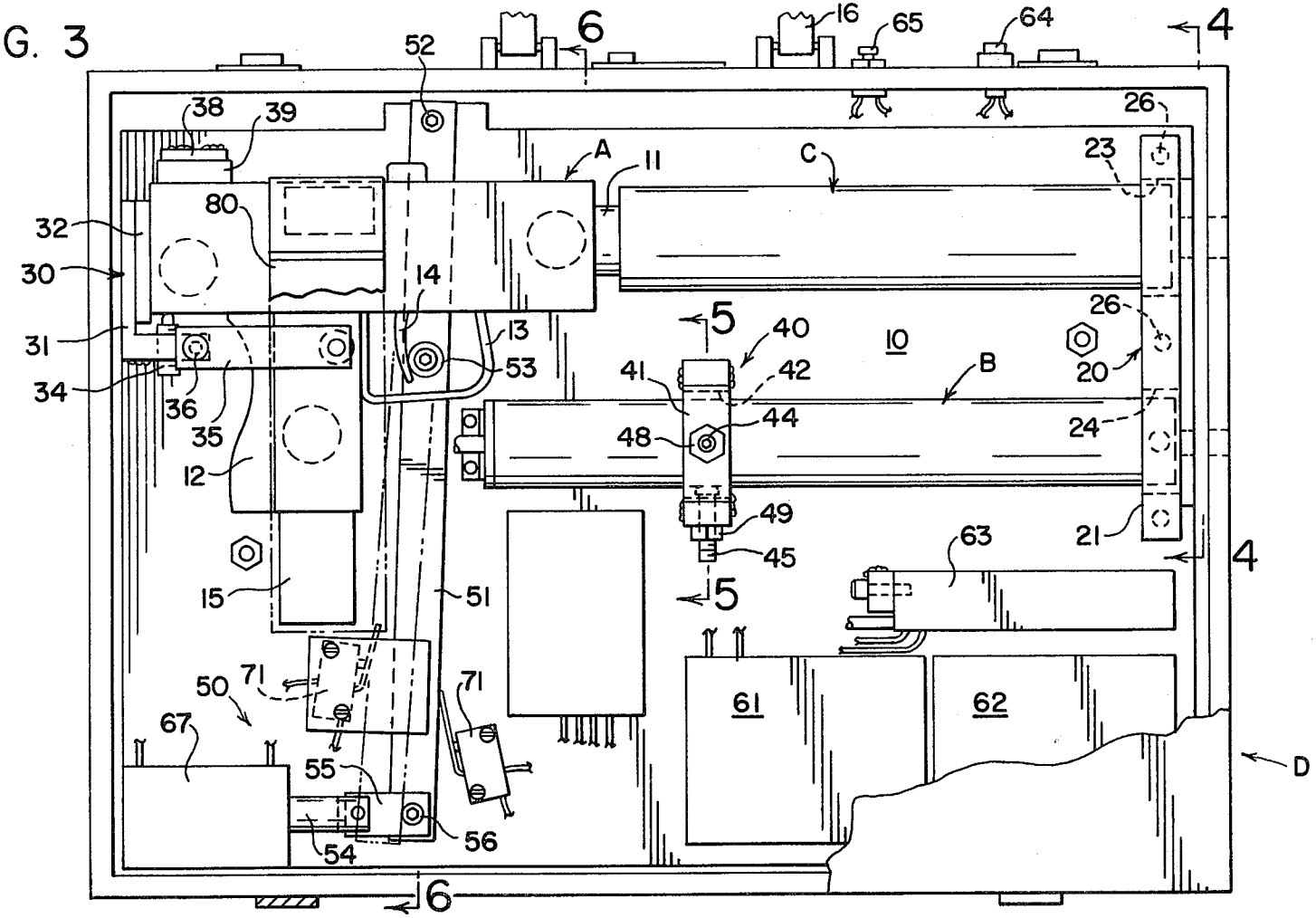
FIG. 3 is a plan view showing the various components of the device located in the briefcase.
Figure 4:
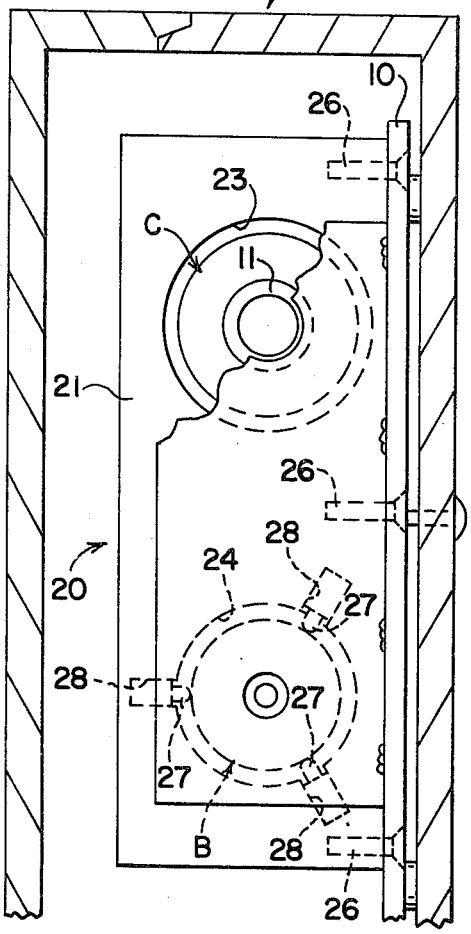
FIG. 4 is a fragmentary, sectional view taken on the line 4—4 of FIG. 3.

Referring initially to FIGS. 2 and 3, there is shown a laser-sighted firing device embodying the invention and including generally a firing piece A in the form of an Ingram M-11 0.380 cal. machine pistol, a laser-sighting assembly B in the form of a helium-neon laser generator, and a suppressor C mounted on the end of the barrel of the M-11. The firing piece A, sighting assembly B, and suppressor C are all located in a portable enclosure or briefcase D which is shown being carried (dashed lines) and operated (solid lines) by a user in FIG. 1.

The M-11 machine pistol is manufactured and sold by R.P.B. Industries, of Atlanta, Ga., and has both automatic and semiautomatic modes and a mode selector located on the left side of the lower receiver. In the automatic mode, the weapon has a firing rate of 1200 rounds per minute and utilizes a 32-round conventional magazine. The suppressor C is a Sionics-type silencer also manufactured by R.P.B. Industries, of Atlanta, Ga.

The helium-neon type laser generator is manufactured by C.W. Radiation, division of Beta Corporation, of Pittsburgh, Pa., under the designation OEM2R(HD), and is rated at 2 milliwatts output. It uses a power supply, for example, of the type manufactured under Model No. L23 by Power Technology, Inc., of Little Rock, Ark.

The firing piece A, sighting assembly B, and suppressor C are all fixed to a mounting base 10, as best shown in FIGS. 2 and 3, by means of a laser and suppressor yoke assembly 20, a rear mounting assembly 30, and a laser windage and elevation yoke 40. The firing piece A is operated by means of a trigger-operating assembly 50, which is controlled by an electrical control system 60 that includes a burst control system 70.

The firing piece A includes a barrel 11, a grip 12, a trigger guard 13, and a trigger 14 located therein. The rounds are fed from a clip 15 which is loaded in the grip 12 in a conventional manner. The suppressor C is threaded onto the barrel 11 in a conventional manner and the front end thereof is resiliently retained in the laser and suppressor yoke assembly 20.

The rearward end of the piece A is clamped in place by the rear piece mounting assembly 30 which includes a recoil absorbing means, to be described below. The front end of the sighting assembly B is also held in the laser and suppressor yoke assembly 20 and is supported intermediate its ends by the laser windage and elevation yoke assembly 40 which provides means for calibrating the laser beam relative to the line of fire of the firing piece A.

The laser and suppressor yoke assembly 20 is mounted at the forward end of the mounting base 10 and includes a yoke block 21 that defines an opening 23 that receives the forward end of the suppressor C and a second opening 24 that receives the forward end of the sighting assembly B. The yoke block 21 is secured to the mounting base 10 by machine screws 26.

The suppressor C extends through the opening 23 with about a one-eighth inch clearance. This arrangement accommodates the customary "whip" of the suppressor C that occurs during firing and minimizes the transmission of the forces to the yoke block 21 and mounting base 10. The forward end of the sighting assembly B is retained in the opening 24 and cushioned against shock by spring-loaded pins 27 mounted in radially extending bores 28.

Figure 6:
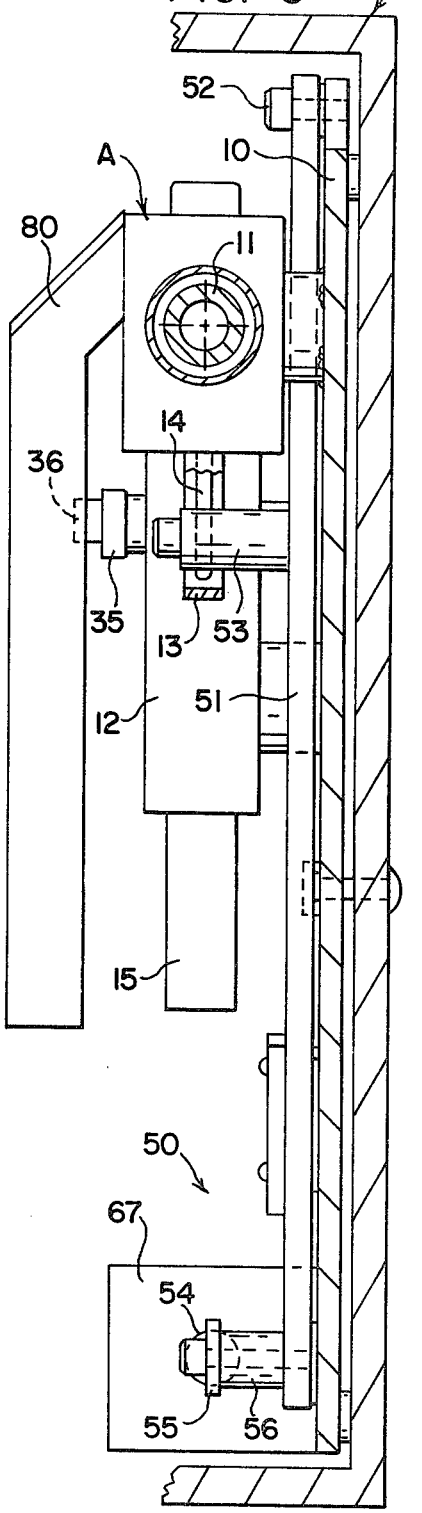
FIG. 6 is a fragmentary, sectional view taken on the line 6—6 of FIG. 3.

The rear piece mounting assembly 30 is shown in FIGS. 3 and 6, and includes an L-shaped recoil plate 31 with a resilient TEFLON pad 32 mounted thereon that engages the rearward end of the firing piece A and a top block 38 with a TEFLON pad 39 that engages the top of the firing piece. A hexhead adjusting screw 34 extends through the base of the bracket 31 and bears against the rearward end of the piece A to secure it against movement parallel to the mounting base 10 and perpendicular to the barrel 11. A clamping bar 35 extends across the top of the bracket 31 and grip 12 and has a locating screw 36 thereon that secures the bar 35 to the bracket 31 and the grip 12.

Figure 5:
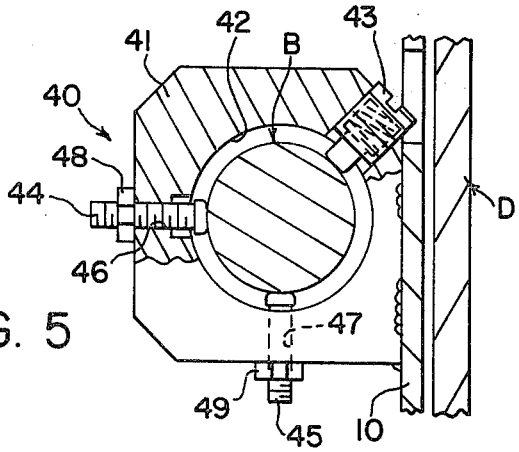
FIG. 5 is a fragmentary, sectional view taken on the line 5—5 of FIG. 3.

The sighting assembly B is gripped near its rearward end by the laser windage and elevation yoke 40 (FIG. 5), which comprises a block 41 with an opening 42 formed therein and through which the sighting assembly B passes. The assembly B is gripped at three points by three different assemblies, including a spring-loaded pin carried in a hollow screw 43 that is threaded into a radial bore in the block 41, the pin being adapted to flex in response to adjustment of a windage adjusting screw 44 and an elevation adjusting screw 45. The screws 44 and 45 extend through radial threaded bores 46 and 47, the bore 46 extending horizontally and the bore 47 extending vertically to provide adjustment along perpendicular axes. The adjustment is made by turning the screws 44 and 45 to the desired position and then tightening down the respective nuts 48 and 49 to lock the screws 46 and 47 in the proper position. The pin in the hollow screw 43 is properly tensioned to minimize any movement during firing.

The trigger 14 of the firing piece A is operated by means of a trigger operating assembly 50 that includes a lever 51 mounted at its upper end by a pivot pin 52 and which has a trigger-operating pin 53 mounted thereon and adapted to extend through the trigger guard 13 and engage the trigger 14. Located adjacent the lower end of the lever 51 is solenoid 67 with a plunger 54 connected to a link 56, which in turn is connected to the lever 51 by a pin 56. Thus, movement of the plunger 55 in a rearward direction brings the trigger-operating pin 53 against the trigger 14 to fire the piece in response to actuation of the solenoid 67.

Also mounted on the mounting base and comprising part of the electrical control circuit are a battery pack 61 and a laser power supply 63. The laser power supply 63 supplies the high voltage for the laser sighting assembly B and is identified, for example, as Model No. L-23-1, manufactured by Power Technology Corporation. The battery pack 61, adapted to provide 4 ampere hours at 12 volts, is manufactured by Power Sonics Corporation, of San Clemente, Calif. The battery pack 61 is rechargeable, there being an external receptacle 66 located on the portable case D to permit recharging as needed.

The power supply 63 for the laser generator B and the battery packs 61 and 62 for operating the solenoid 55 are best shown in FIG. 3. The electrical control system 60 is activated by a remote switch 64 which is a double-pole, double-throw switch of the push-on, push-off type that closes the circuit to the laser power supply 63, and thus to the laser generator B, and also closes the circuit that arms the firing switch 65 for operating the solenoid 67.

Figure 7:
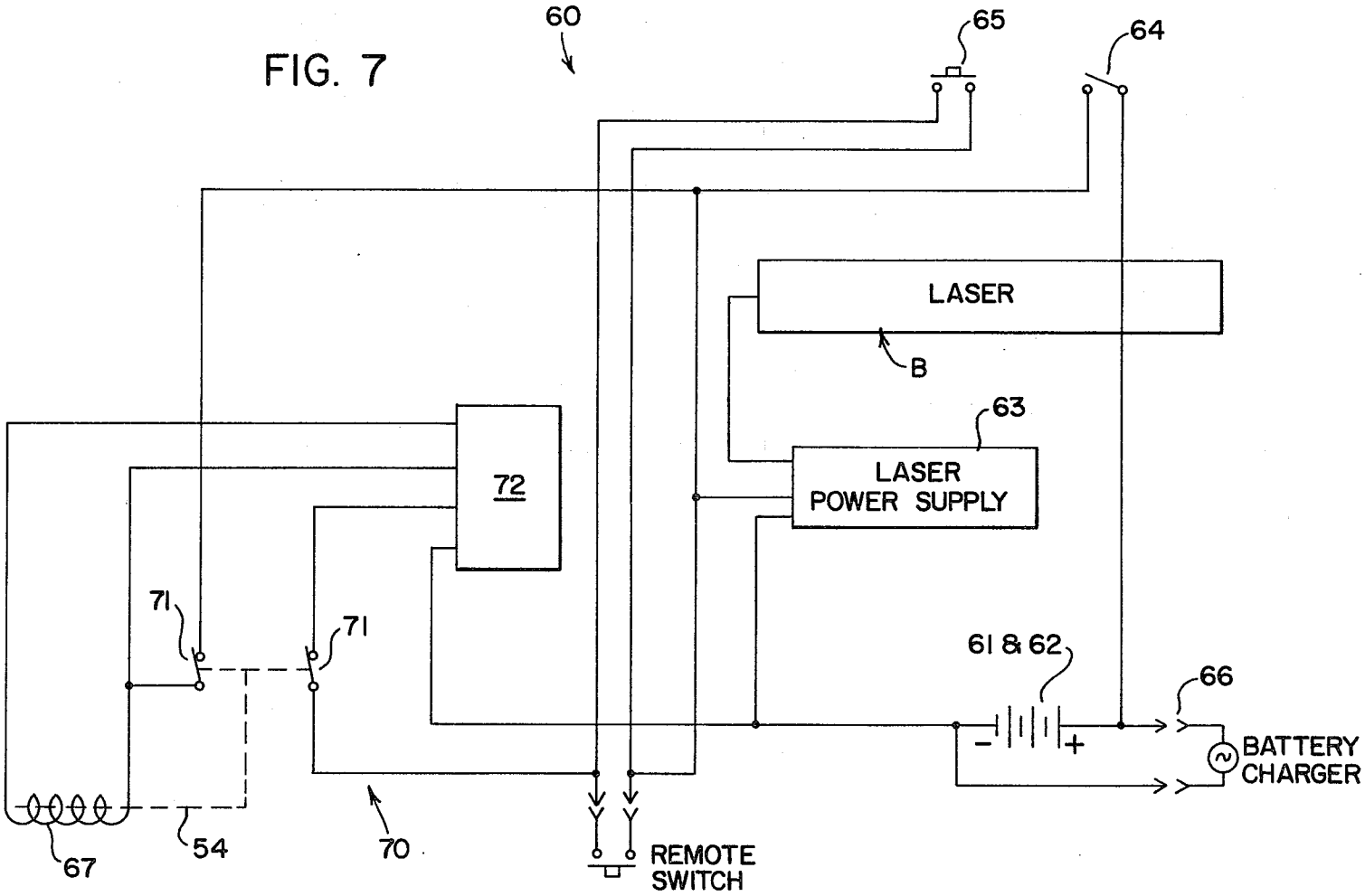
FIG. 7 is a schematic diagram illustrating the electrical control system for the device of the invention.

The control circuit 60 also includes a burst control circuit 70 that permits an operator to fire as few as two or three rounds each time the firing switch 65 is depressed. This prevents long bursts of seven or eight rounds, which is about the least number of rounds that the operator is normally capable of firing. The burst control system includes a trip switch 71 that is tripped each time the lever 51 is moved by the solenoid plunger 54 to the firing position, and thus quickly shuts off the power to the solenoid 67 through a timing circuit 72 (FIG. 7). The timing circuit is a commercially available electronic component well known in the art. In this way, each time the firing switch 65 is depressed, a burst of two or three rounds is fired and additional firings require an additional depressing of the firing switch. This avoids the scattering of rounds which are inevitable after a few rounds have interfered with the ability of the operator to control the aiming spot.

OPERATION

Operation of the device is relative simple and commences with the loading of a clip 15 and the insertion of the clip into the handle of the firing piece A with the firing piece removed from the base 10. The suppressor C is then secured to the barrel 11. The loaded piece A is then placed in position on the base 10 and secured, using the yoke assembly 20 and the rear piece mounting assembly 30. Then the briefcase D is closed and the user carries the device, as illustrated in FIG. 1, to wherever its use is required. The briefcase is not a threatening item and, as a result, does not alert a terrorist or other lawbreaker to the presence of the weapon. When the user is properly positioned to use the weapon, he presses the arming switch 64, which activates the laser generator B and places an aiming spot wherever the device is pointed. The user then places the aiming spot on the target and immediately presses the firing switch 65. The firing switch 65, which closes the circuit to the solenoid 67, operates the solenoid plunger 54 to pull the lever 51 rearwardly and thus force the trigger-operating pin 53 against the trigger 14 to depress the trigger and fire the weapon, presumably in the automatic mode.

At the same time that the lever reaches the limits of its rearward extension, it trips the burst control switch 71, which activates the timing mechanism 72, which in turn shuts off the power to the solenoid after a period of time sufficient to permit the firing of about two or three rounds. If the user desires to fire an additional burst, he first moves the briefcase to return the laser spot to the desired target and then again depresses the firing switch button 65 to fire off another burst of two or three rounds.

It will be apparent, assuming three rounds are fired with each burst, that ten separate bursts may be fired from the 32-round clip without need for reloading. After the target has been neutralized, the user switches off the system by pressing the arming switch 64 to open the control circuit.

Preferably, the lid of the case D is provided with a shell catcher 80 designed and positioned (FIGS. 2 and 3) to receive the ejected brass shell casings that would otherwise be accumulated throughout the interior of the case during firing. Such a receptacle minimizes the amount of dirt and other debris that would tend to accumulate in the briefcase during firing.

While the invention has been shown and described with respect to a specific embodiment thereof, this is intended for the purpose of illustration rather than limitation, and other variations and modifications of the specific device herein shown and described will be apparent to those skilled in the art, all within the intended spirit and scope of the invention. Accordingly, the patent is not to be limited in scope and effect to the specific device herein shown and described, nor in any other way that is inconsistent with the extent to which the art has been advanced by the invention.

We claim:

1. A laser-sighted firing device comprising:

a rigid mounting base, a firing piece removably mounted on said base and including a mechanical trigger mechanism, a sighting device mounted on said base and including a laser generator for projecting a visible aiming spot on a target approximately in the line of fire of said firing piece, means on said base for supporting said laser generator and for adjusting the position of said laser generator relative to said firing piece to calibrate the laser beam projected therefrom relative to the line of fire of said firing piece, a lever pivotally mounted at one end on said base for pivotal movement about an axis perpendicular to said base, electrical actuating means connected between the other end of said lever and said base for moving said lever relative to said base, means intermediate the ends of said lever operatively associated with said trigger mechanism for firing said piece in response to movement of said lever, power supply means for said laser generator, electrical means for energizing said actuating means and including a manually operable switch therefor, and portable enclosing means in the form of a briefcase or the like for supporting said base and for concealing said firing piece, said manually operable switch including an element manually engageable from the exterior of the enclosing means, said electrical means including an electrical circuit having burst control means for limiting the number of rounds fired by said piece to a predetermined limited number each time said manually operable switch is actuated.

2. A laser-sighted firing device as defined in claim 1, wherein said firing piece comprises a machine pistol.

3. A laser-sighted firing device as defined in claim 2, wherein said machine pistol has a suppressor attached to the barrel thereof.

4. A laser-sighted firing device as defined in claim 3, wherein said machine pistol is a magazine-loaded, .380 cal. automatic machine pistol.

5. A laser-sighted firing device as defined in claim 1, wherein said sighting device comprises a helium-neon laser generator.

6. A laser-sighted firing device as defined in claim 1, wherein said electrical actuating means comprises a solenoid.

7. A laser-sighted firing device as defined in claim 2, said burst control means limiting the number of rounds fired by said machine pistol to between two and three each time said manually operable switch is actuated.

8. A laser-sighted firing device as defined in claim 7, wherein said burst control means comprises a trip switch incorporated in said electrical means that is tripped each time said lever is moved to its firing position, and a timing circuit operatively associated with said trip switch for quickly de-energizing said electrical actuating means each time said trip switch is actuated.

* * * * *